US005185931A

United States Patent [19]

Fujikawa et al.

[11] Patent Number: 5,185,931

[45] Date of Patent: Feb. 16, 1993

[54] HAIR CUTTER

[75] Inventors: Shoji Fujikawa, Ishibe; Hideaki Haraguchi, Hikone, both of Japan

[73] Assignee: Matsushita Electric Works, Ltd., Osaka, Japan

[21] Appl. No.: 885,055

[22] Filed: May 13, 1992

Related U.S. Application Data

[63] Continuation of Ser. No. 705,541, May 24, 1991, abandoned.

[30] Foreign Application Priority Data

May 28, 1990 [JP] Japan ..... 2-137751
Dec. 25, 1990 [JP] Japan ..... 2-405528

[51] Int. Cl.[5] ..... B26B 19/00; ;

[52] U.S. Cl. ..... 30/201; 30/195

[58] Field of Search ..... 30/43.1, 195, 200–202, 30/233.5, 241, 242

[56] References Cited

U.S. PATENT DOCUMENTS 4,557,050 12/1985 Haraguchi et al. ..... 30/201 X
4,776,095 10/1988 Tsujimoto et al. ..... 30/201
5,050,304 9/1991 Fujikawa et al. ..... 30/196

FOREIGN PATENT DOCUMENTS 52-288443 7/1977 Japan .

*Primary Examiner*—Douglas D. Watts

*Attorney, Agent, or Firm*—Stevens, Davis, Miller & Mosher

[57] ABSTRACT

A hair cutter having a cutter head with a cutter comprising a toothed stationary blade and a toothed movable blade which define a cutting plane between toothed edges thereof. The movable blade reciprocates relative to the stationary blade in hair shearing engagement between the toothed edges with the movable blade defining a cutting edge at its leading toothed edge. Disposed at the front end of the cutter head is a pair of first and second hair pressing members with respective hair contacting edges. The first hair pressing member is formed to have a number of comb slots arranged in parallel with the toothed edges of the movable blade with the comb slots defining at their bottom ends the hair contacting edge. The first and second hair pressing members are located on the opposite sides of the cutting plane, respectively to have the individual hair contacting edges spaced across the cutting plane in such a manner that the cutting edge of the cutter is positioned on or rearwardly of a line connecting the hair contacting edges of the first and second hair pressing members. The hair contacting edges of the first and second hair pressing members are cooperative to hold the hairs at spaced portions along the length of the hairs so as to keep the thus held hairs out of shearing contact from the cutting edge, thereby permitting the cutting edge to cut only the hairs which flex toward the cutting edge, these being hairs which have slipped away from one of the hair contacting edges.

9 Claims, 24 Drawing Sheets

HAIR CUTTER

This application is a continuation of application Ser. No. 07/705,541, filed May 24, 1991 now abandoned.

BACKGROUND OF THE INVENTION

1. Field of the Invention

The present invention is directed to a hair cutter, and more particularly to a hair cutter capable of easily styling the hairs into a smoothly contoured finish.

2. Description of the Prior Art

Hair cutters have been long desired to effect smooth hair styling even by an unskilled person. To this end, U.S Pat. 4,557,050 has proposed to use a pair of hair pressing members disposed on the opposite sides of a cutting plane defined between a movable cutter blade and a stationary cutter blade. The hair pressing members are utilized to press the hairs towards the scalp and hold the hairs at the spaced portions along the length of the hairs while advancing the cutter along the length of the hairs in order to cut the hairs held by the two spaced hair pressing members, thereby enabling the operator to effect a smooth hair cutting operation. In this patent, however, a cutting edge at the front edge of the movable cutter blade projects forward past a line connecting the hair contacting edges of the two spaced hair pressing members so that the hairs supported by the hair pressing members are in touch with the cutting edge so as to be sheared thereby. Consequently, it is likely to cut the long hairs which are not intended to be cut simply because they straddle over the hair contacting edges of the pressing members. With this result, it is difficult to provide a smoothly contoured hair style free from noticeable steps therein.

SUMMARY OF THE INVENTION

The above problem has been eliminated in the present invention which provides an improved hair cutter for facilitating to cut the hair into a smooth hair styling without requiring a degree of skill. The improved hair cutter in accordance with the present invention comprises a cutter head with a cutter comprising a toothed stationary blade and a toothed movable blade which define a cutting plane between the toothed edges thereof. The movable blade is driven to reciprocate relative to the stationary blade in hair shearing engagement between the toothed edges with the movable blade defining a cutting edge at its leading toothed edge. Disposed at the front end of the cutter head is a spaced pair of first and second hair pressing members with respective hair contacting edges. The first hair pressing member is formed to have a number of comb slots arranged in parallel with the toothed edges of the movable blade with the comb slots defining at their bottom ends the hair contacting edge. The first and second hair pressing members are located on the opposite sides of the cutting plane, respectively to have the individual hair contacting edges spaced across the cutting plane in such a manner that the cutting edge is positioned on or rearwardly of a line connecting the hair contacting edges of the first and second hair pressing members. The contacting edges of the first and second hair pressing members are cooperative to hold the hairs at spaced portions along the length of the hairs so as to keep thus held hairs out of shearing contact from the cutting edge, thereby permitting the cutting edge to cut only the hairs which flex toward the cutting edge as being slipped away from one of the hair contacting edges. Therefore, as the cutter head is manipulated to advance the cutter along the stream of the hairs, the hairs once held by the spaced contacting edges are allowed to flex toward the cutter as a consequence of that the tips of the hairs are successively released from the leading one of the spaced contacting edges to be cut by the cutting edge, thereby cutting the long hairs only at portions adjacent to their tips and not at the other portions adjacent to the roots of the hairs. In this manner, the long hairs can be successively cut to substantially a uniform length simply by advancing the cutter along the length of the hairs and therefore can be cut into a smooth hair styles free from any noticeable steps along the length of the stream of the hairs.

Accordingly, it is a primary object of the present invention to provide an improved hair cutter which is capable of cutting the hairs into a smooth hair style easily even by an unskilled person.

In a preferred embodiment, the first hair pressing member is formed in its forward end with comb teeth forming therebetween the comb slots. The comb teeth extend forwardly of the cutting edge and are bent toward the second hair pressing member beyond the cutting edge or the cutting plane. With the provision of the comb teeth extending across the cutting plane forwardly of the cutting edge, the comb teeth can reach deep into the hairs during the manipulation of advancing the cutting edge across the scalp so as to lift the hairs lying flat against the scalp of the head for combing the hairs into shearing contact with the cutting edge.

It is therefore another object of the present invention to provide an improved hair cutter which is capable of readily lifting the flattened hairs to be sheared by the cutter for effective hair cutting.

The first hair pressing member formed with the comb teeth is disposed on the same side of the cutter head as is the movable blade in relation to the cutting plane. With this arrangement, the stationary blade acts to lead the cutting edge while manipulating the cutter to comb the hairs by the comb teeth at the first hair pressing member with the cutting edge of the movable blade following the stationary blade in the advancing direction of the cutter. Thus, the toothed edge of the stationary blade can also act to comb the hairs in advance of the cutting edge and therefore prevent the hairs from being entangled with the reciprocating toothed edge of the movable blade for assuring safe hair cutting operation, which is therefore a further object of the present invention.

In preferred embodiments, the second hair pressing members is movable relative to the cutter head so as to vary a distance from the hair contacting edge thereof to the cutting edge in a direction parallel or perpendicular to the cutting plane, thereby adjusting a cutting length or thickness of the hairs to be cut at a time.

It is therefore a still further object of the present invention to provide an improved hair cutter which is capable of adjusting the cutting length or thickness of the hairs to be cut at a time for effecting a delicate hair style as desired.

The second hair pressing member is preferably formed with a recess rearwardly of the hair contacting edge for collection of clipped hairs in order to prevent the clipped hair from scattering outwardly of the cutter head.

These and still other objects and advantageous features of the present invention will become more apparent from the following description of the preferred embodiments when taken in conjunction with the attached drawings.

DETAILED DESCRIPTION OF THE EMBODIMENTS

First embodiment <FIGS. 1 to 8>

Figure 1:
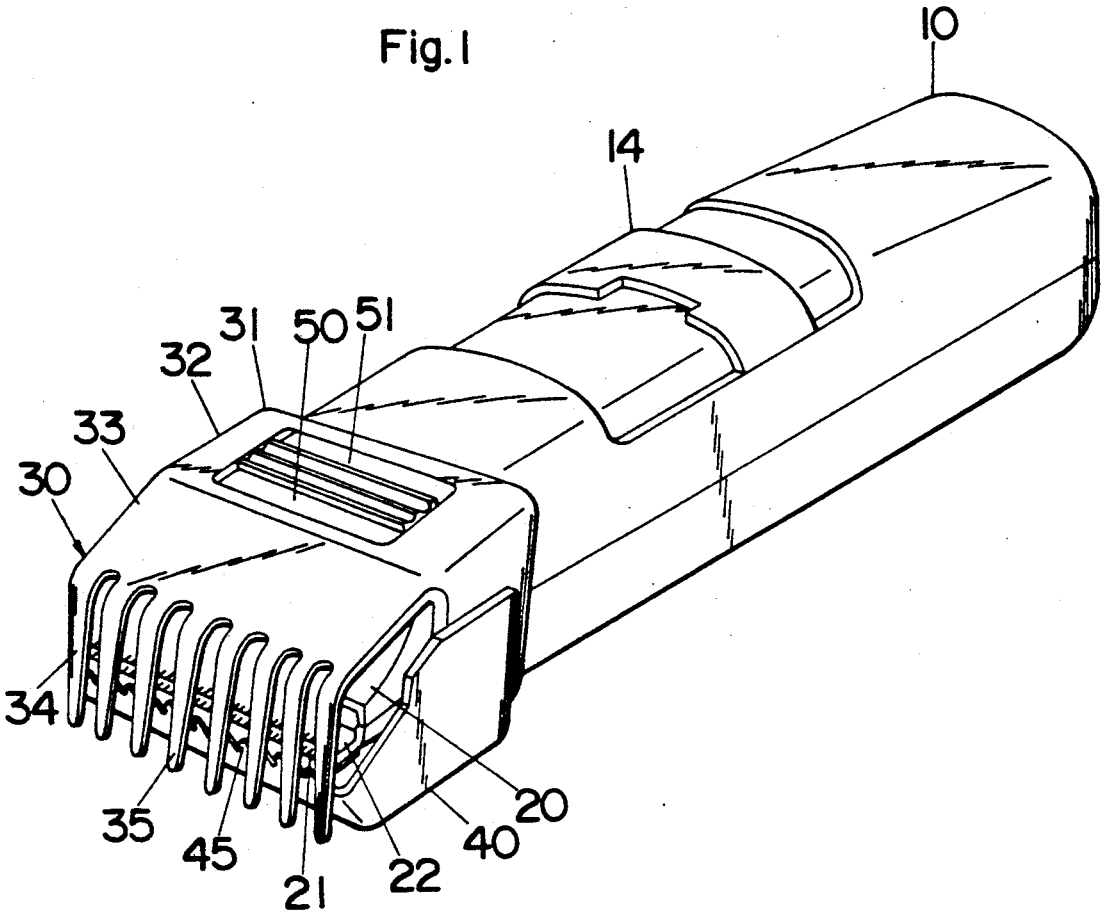
FIG. 1 is a perspective view of a hair cutter in accordance with a first embodiment of the present invention.
Figure 2:
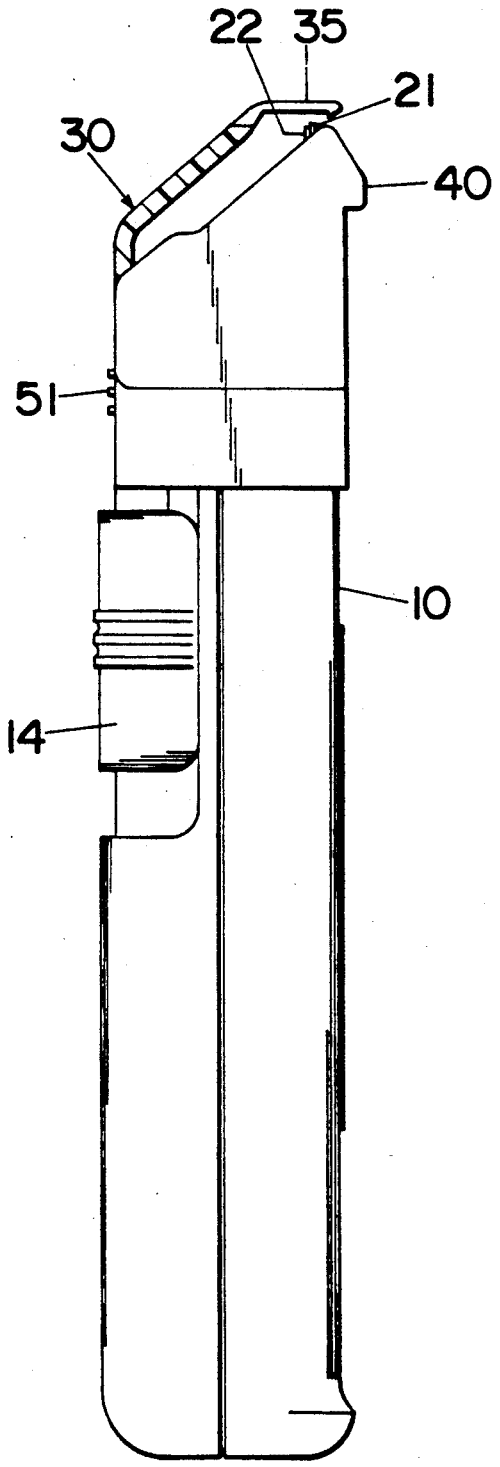
FIG. 2 is an elevation, partly in section, of the hair cutter with a comb attachment.
Figure 3:
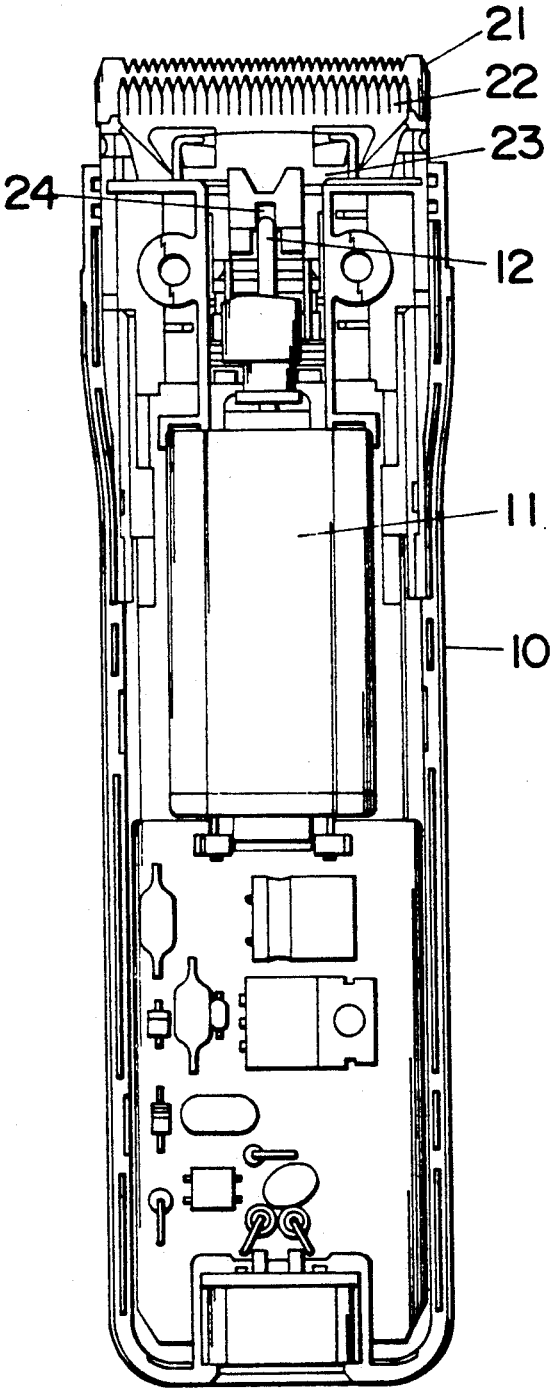
FIG. 3 is a top view illustrating an internal structure of the hair cutter.

Referring now to FIGS. 1 to 3, there is shown a hair cutter in accordance with a first embodiment of the present invention. The hair cutter comprises an elongated housing 10 to be grasped by the hand of a user, a cutter head 20 provided at the front end of the housing, and a comb attachment 30 demountable from the cutter head 20. The cutter head 20 includes a cutter comprising a toothed stationary blade 21 and a toothed movable blade 22 which define therebetween a cutting plane generally parallel to the bottom surface of the housing 10. As shown in FIG. 3, the movable blade 22 is placed over the stationary blade 21 and is held on a carrier plate 23 with a cam slot 24 for driving connection to a motor 11 accommodated in the housing 10. A drive pin 12 connected and eccentric to an output shaft of the motor 11 projects into the cam slot 24 to translate the eccentric rotary movement of the pin 12 into a reciprocatory movement of the movable blade 22. Thus, the movable blade 22 is driven to reciprocate along the length of the stationary blade 21 in hair shearing engagement between the toothed edges thereof. The movable blade 22 has its leading edge positioned rearwardly of the corresponding leading edge of the stationary blade 21 to thereby define at the leading edge of the movable blade 22 a cutting edge of the cutter from which extends rearwardly an effective shearing zone for shearing the hairs between the toothed edges of the stationary and movable blades 21 and 22. The housing 10 is provided in its top with a switch handle 14 for energizing and deenergizing the motor 11.

The comb attachment 30 comprises a main body 31 of tubular configuration fitted around the cutter head 20 and a jaw 40 slidably supported on the main body 31. As shown in FIG. 1, the main body 31 has an downwardly inclined section 33 extending forwardly from a rear tube section 32 and a nose section 34 integrally extending downwardly from the front end of the inclined section 33 in a forwardly spaced relation to the cutting edge of the cutter. The nose section 34 is formed with a plurality of comb teeth 35 arranged in parallel with the cutting edge of the cutter with a portion of each comb teeth 35 extending into the front end of the inclined section 33. In other words, comb slots formed between the adjacent comb teeth 35 extends from the front end portion of the inclined section 33 to the lower end of the nose section 34 in such a manner as to position the bottom 36 of the slot on or rearwardly of the cutting edge, as shown in FIG. 2, when the comb attachment 30 is mounted on the cutter head 20. It should be noted here that the bottom of the comb slot defines a hair contacting edge 36 while the comb teeth 35 are combing the hairs toward the cutting edge, as discussed in detail hereinafter.

Figure 4A:
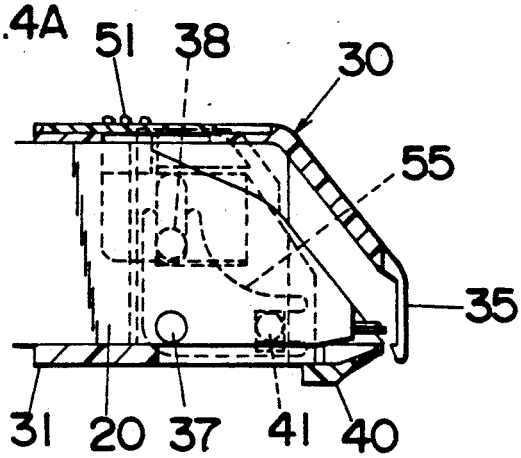
FIGS. 4A to 4C are partial views illustrating in different sections the connection of the comb attachment to a cutter head of the above hair cutter with the comb attachment shown in its retracted position.
Figure 4B:
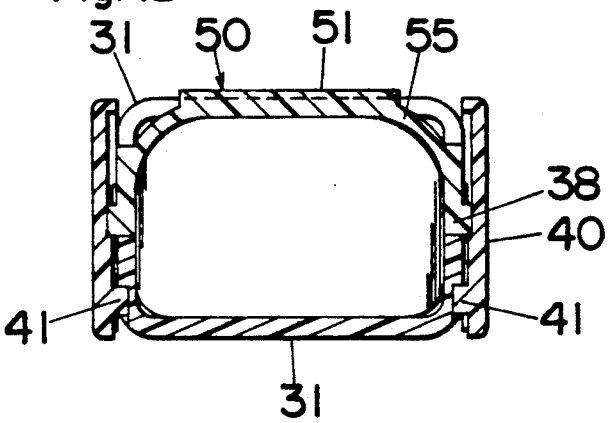
Figure 4C:
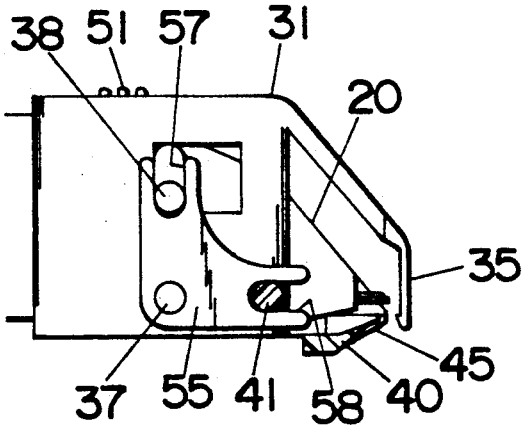
Figure 5A:
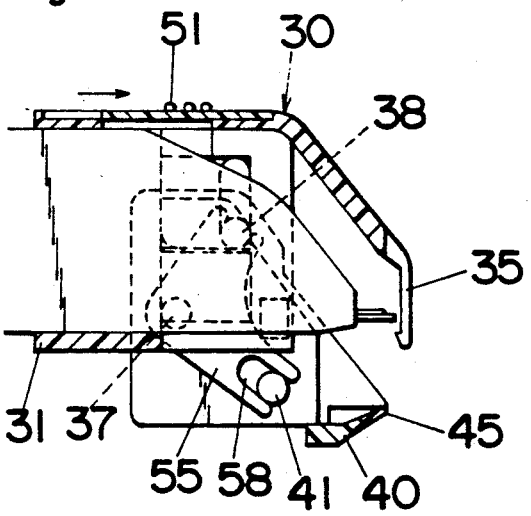
FIGS. 5A to 5C are partial views illustrating in different sections the connection of the comb attachment to the cutter head with the comb attachment shown in its extended position.
Figure 5B:
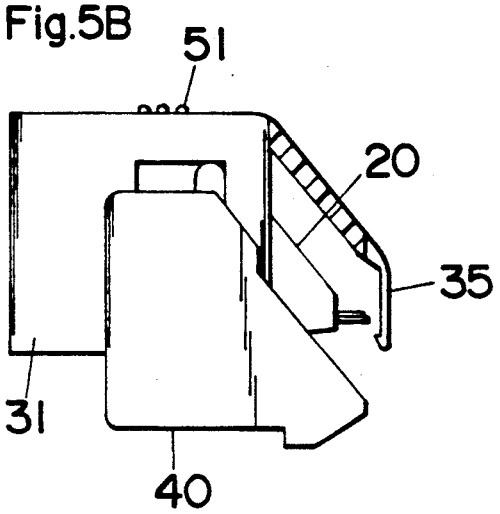
Figure 5C:
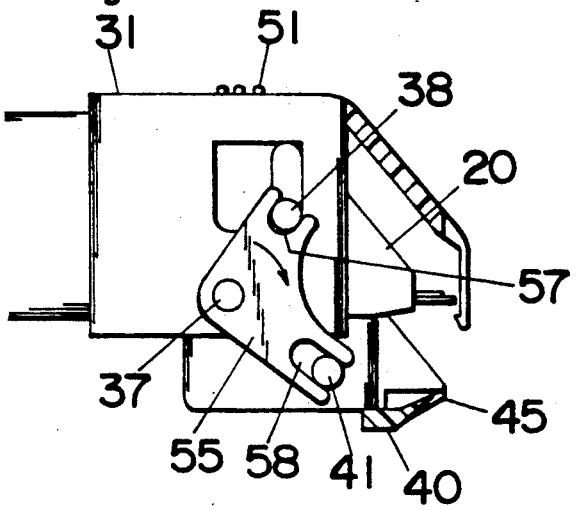

As shown in FIGS. 4A to 4C, the jaw 40 is linked to L-shaped bell-cranks $$ which are disposed respectively on the opposed side walls of the main body 31. Each bell-crank 55 has a pair of legs with slots 57 and 58 and pivotally supported to the main body 31 by means of a pivot pin 37 projecting on the lower side end of the main body 31. The lower slot 58 slidably receives each one of pins 41 projecting from the lower front end on the opposite sides of the jaw 40, while the upper slot 57 of each crank 55 slidably receives each one of pins 38 on the opposite sides of a cut length adjuster 50 which is slidable within the main body 31 in the lengthwise direction of the housing 10 with a handle 51 exposed through the ring section 32 of the main body 31 to be accessible by the finger of the user. As shown in FIGS. 4A and 4C, when the handle 51 is in its rearmost position, the jaw 40 is kept in its uppermost position where the front edge of the jaw 40 is immediately adjacent to the cutting edge of the cutter. As the handle 51 is moved forwardly to a position of FIGS. 5A to 5C, the crank 55 is caused to pivot downwardly for displacing the jaw 40 to a lowered position where the front edge of the jaw 40 is spaced vertically from the cutting edge of the cutter. The jaw 40 is formed at its forward edge with a row of teeth 45 forming therebetween corresponding slots which define at their bottom a hair contacting edge 46, like the hair contacting edge 36 for the comb teeth 35 of the main body 31.

Figure 6:
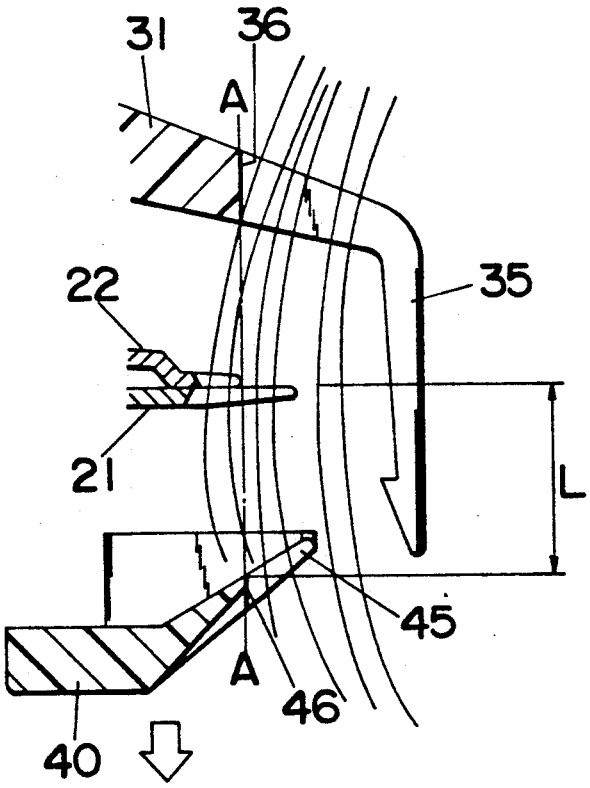
FIG. 6 is an enlarged view illustrating a hair cutting mode characterizing the above hair cutter.

As the cutter head 20 with the comb attachment 30 is manipulated to advance along the stream of the hairs together with the cutting head 20 as indicated by an arrow in FIG. 6, the hairs are combed toward the cutting edge as being pressed at spaced portions along the length of the hairs respectively against the hair contacting edges 36 and 46 of the respective comb teeth 35 and 45. As shown in the figure, the cutting edge of the cutter is positioned to be on or rearwardly of a line A—A connecting the hair contacting edges 36 and 46 of the main body 31 and the jaw 40. Since the cutting edge does not project forwardly of the line A—A, the hairs held at the longitudinally spaced portions by the hair contacting edges 36 and 46 are inhibited from reaching the cutting edge and therefore prevented from being sheared thereby. As the comb attachment 30 advances past the tips of some of the hairs, the hairs will flex toward the cutting edge as being released from the hair contacting edge 46 so as to be sheared at portions adjacent the tips of the hairs. In this manner, by successively advancing the cutter head along the length of the hairs, the hairs can be sheared only at the portions adjacent the tips thereof and not at the other portions away from the tips, which enables the head to cut the hairs into a smooth style without leaving noticeable steps therein.

As apparent from the figure, the cut length is determined by a distance L from the cutting plane or the cutting edge to the hair contacting edge 46 of the jaw 40. Since that distance L can be adjusted between the positions of FIGS. 4C and 5C by shifting the handle 51, it is readily possible to vary the cutting length. It is noted in this connection that the comb teeth 35 acts to raise the flattened hairs toward the cutting edge so as to cut not only the surface hairs but also the inner flattened hairs uniformly to a desired length.

Figure 7:
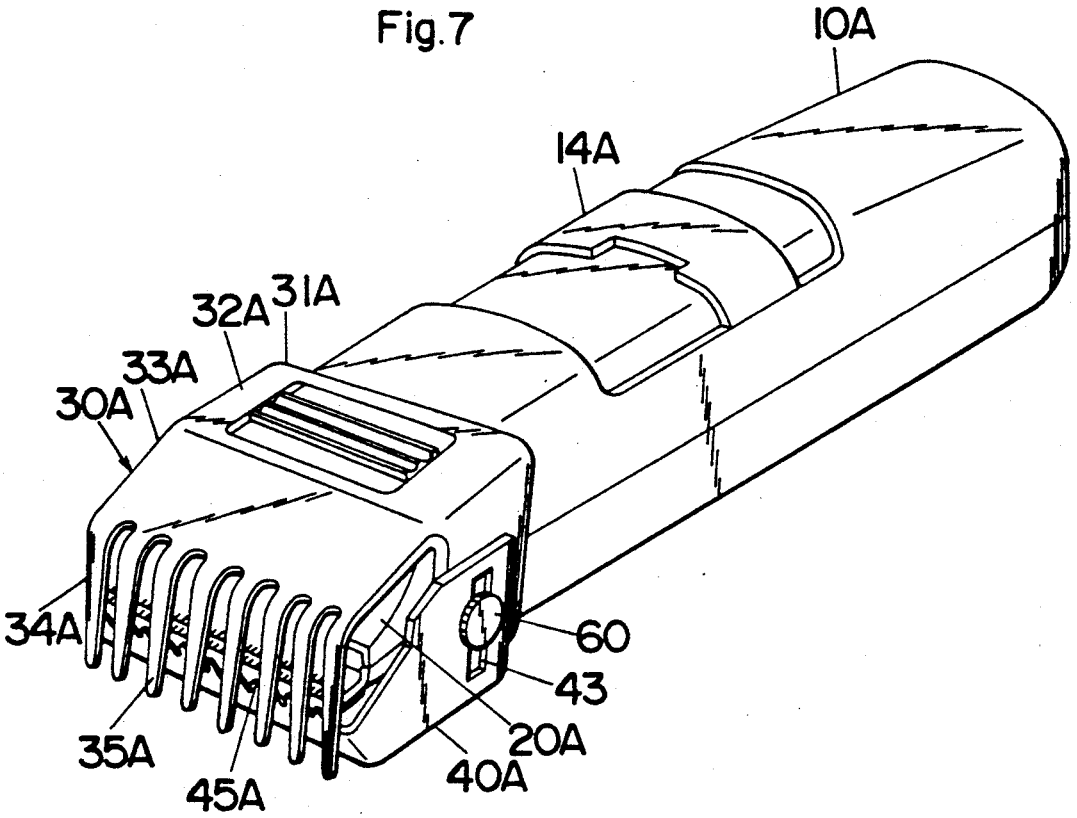
FIG. 7 is a perspective view of a hair cutter in accordance with a modification of the first embodiment.
Figure 8:
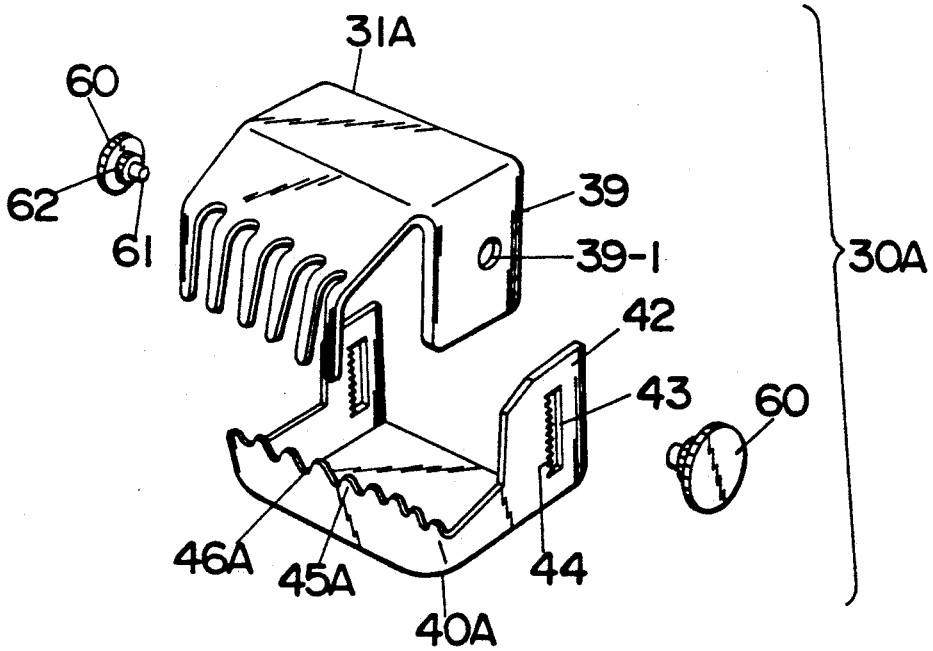
FIG. 8 is an exploded perspective view of a comb attachment fitted on a cutter head of the hair cutter of FIG. 7.

FIGS. 7 and 8 illustrate a modified hair cutter which is basically identical to the first embodiment except for a mechanism of adjusting the position of a jaw 40A relative to the cutting edge. Therefore, like parts are designated by like numerals with a suffix letter "A". A comb attachment 30A of this modification comprises a main body 31A and a jaw 40A which are connected by means of dials 60. The main body 31A is formed to have a base section 32A, an inclined section 33A and a nose section 34A with a row of comb teeth 35A. The jaw 40 is formed at its forward edge with a row of teeth 45A and at this rear end with a pair of upwardly projecting tabs 42 which are fitted over a corresponding pair of ears 39 depending from the sides of the base section 32A. The tabs 42 are each formed with a vertically elongated hole 43 with a rack 44 extending along one lengthwise edge of the hole 43. Each of the dials 60 has an axle 61 extending loosely through the hole 43 into a bearing hole 39-1 of the ear 39 to couple the jaw 40A to the main body 31A Each dial 60 is also formed around the axle 61 with a concentric pinion 62 which is in meshing engagement with the rack 44 of the corresponding hole 43 so that the rotation of the dial 60 causes the jaw 40A to move vertically relative to the main body 31A, thereby adjusting the distance from the hair contacting edge 46A of the jaw 40A to the cutting edge of the cutter in order to meet the requirement of varying the cutting length of the hairs.

Second embodiment <FIGS. 9 to 28>

Figure 9:
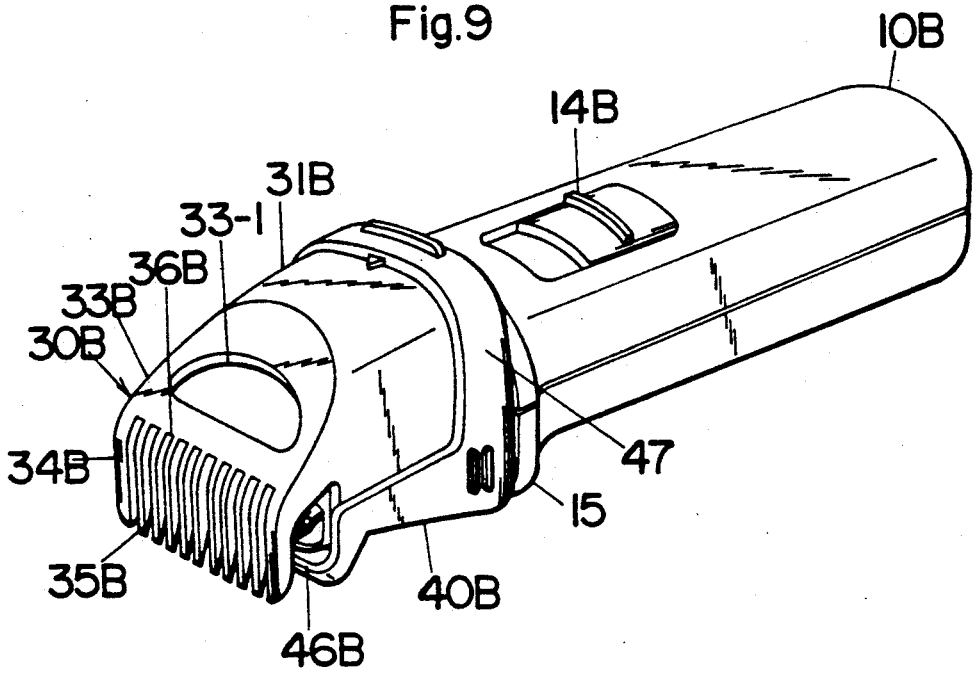
FIG. 9 is a perspective view of a hair clipper in accordance with a second embodiment of the present invention.

FIG. 9 illustrates hair cutter in accordance with a second embodiment of the present invention which provides a comb attachment 30D of different configuration. The other structures are identical to the first embodiment and therefore like parts are designated by like numerals with a suffix letter of "B". The comb attachment 30B comprises a like tubular main body 31B and a jaw 40B pivotally supported thereto. The main body 31B has a rear ring section 32B fitted over the cutter head 20B, an inclined section 33B and a nose section 34B with a row of comb teeth 35B forming therebetween comb slots which define at their bottoms a hair contacting edge 36B. The jaw 40B has a continuous straight edge at its front end which defines a hair contacting edge 46B in parallel with the hair contacting edge of the main body 31B and also with the cutting plane defined between stationary and movable blades 21B and 22B. The jaw 40B includes an arch segment 47 extending from the rear ends of the opposite side members to surround the rear end of the ring section 32B. A pair of pivot pins 37B project on the lower rear end of the opposite side walls of the ring section 32B to be received respectively within corresponding bearing holes 48 in the inner rear ends of the side members so that the jaw 40B pivots between a closed position of FIG. 14A and an open position of FIG. 14B. In the closed position, the hair contacting edge 46B of the jaw 40B is spaced by a short distance L from the cutting edge of the movable blade 22B, as shown in solid lines of FIG. 15, for cutting the hairs by a short length from the tips of the hairs for the reason as discussed in the first embodiment. In the open position, on the other hand, the hair contacting edge 46B is spaced by a greater distance 2L from the cutting edge, as shown in dotted lines of FIG. 15, for cutting the hairs by a relative long length from the tips of the hairs.

Figure 15:
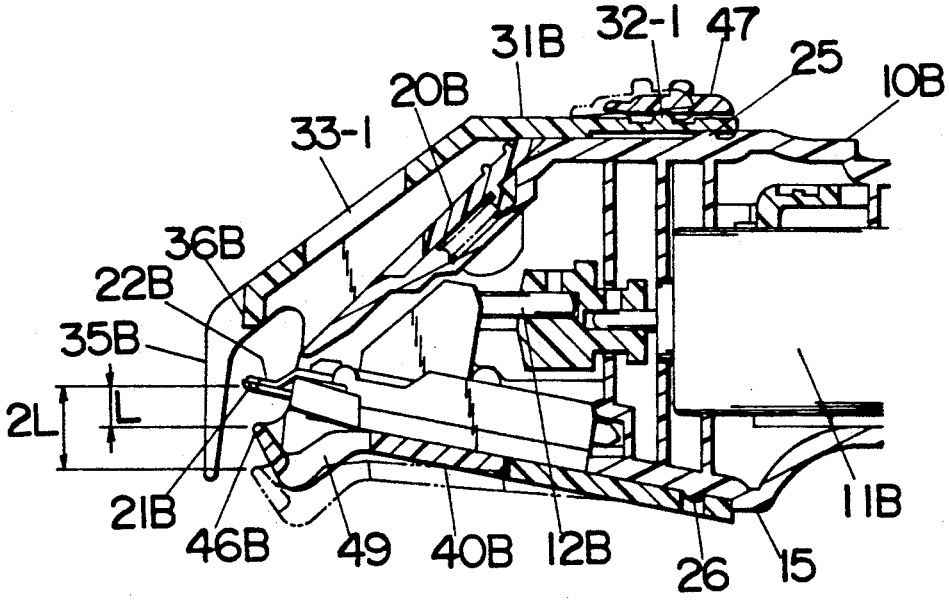
FIG. 15 is a sectional view illustrating the cutter head of the above cutter.
Figure 12:
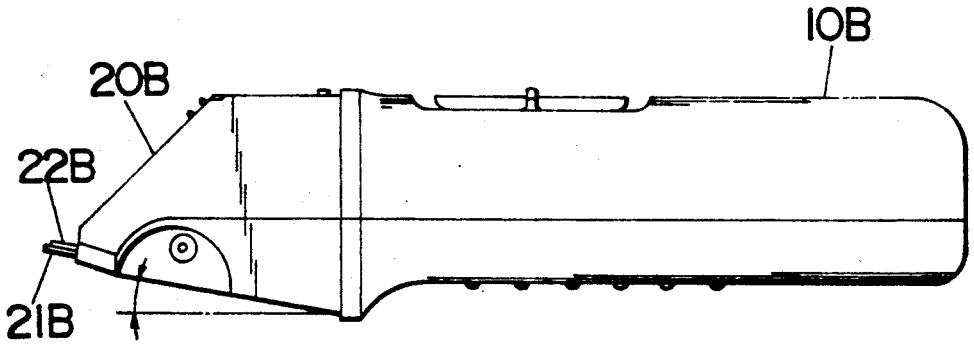
FIG. 12 is an elevation of the above hair cutter with the comb attachment removed therefrom.
Figure 13:
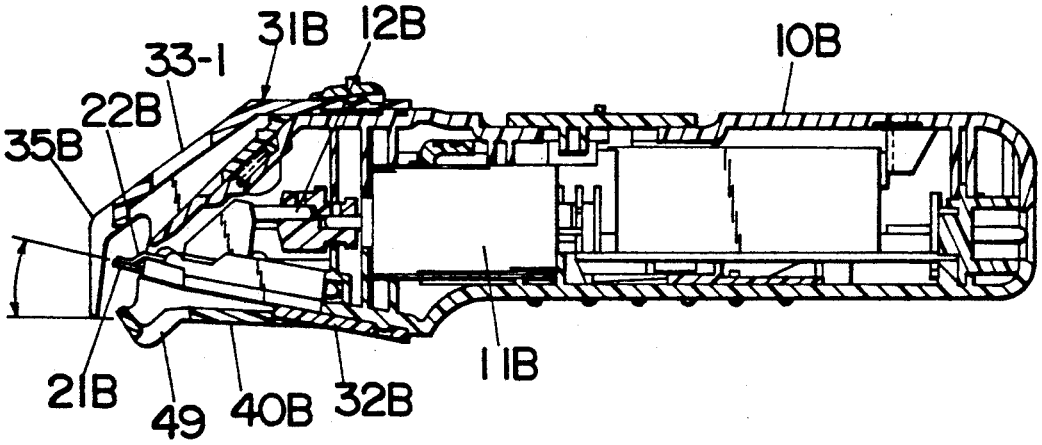
FIG. 13 is a vertical section of the above hair cutter.
Figure 14A:
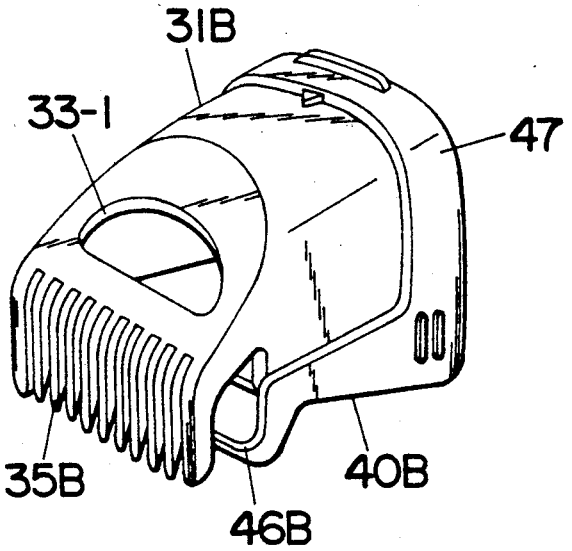
FIGS. 14A and 14B are perspective illustrating a comb attachment with a pivotable jaw shown in different positions, respectively.
Figure 14B:
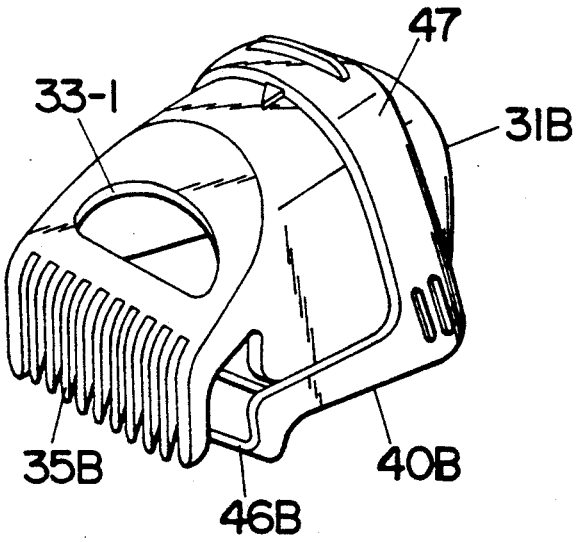

As shown also in FIG. 15, the cutter head 20B is provided at its rear end with projections 25 and 26 which come into snapping engagement with corresponding recesses in the rear end of the main body 31B for detachably mounting the comb attachment 30B on the cutter head 20B. Further, the main body 31B is formed at its rear upper end with a cam projection 32-1 for latching engagement with a corresponding element on the inner top of the arch segment 47 so that the jaw 40B can be latched in either of the closed or open position. The cutter head 20B is separated from the housing 10B by a bulged band 15 which acts to prevent the clipped hairs from reaching the hand of the user gripping the housing 10B. As shown in FIGS. 12 and 13, the cutting plane of the cutter is inclined by an angle of about 10° with respect to a longitudinal axis of the housing 10B and to a general bottom surface of the housing 10B to keep the cutting edge out of contact with a table or the like supporting surface on which the hair cutter is placed.

Figure 16:
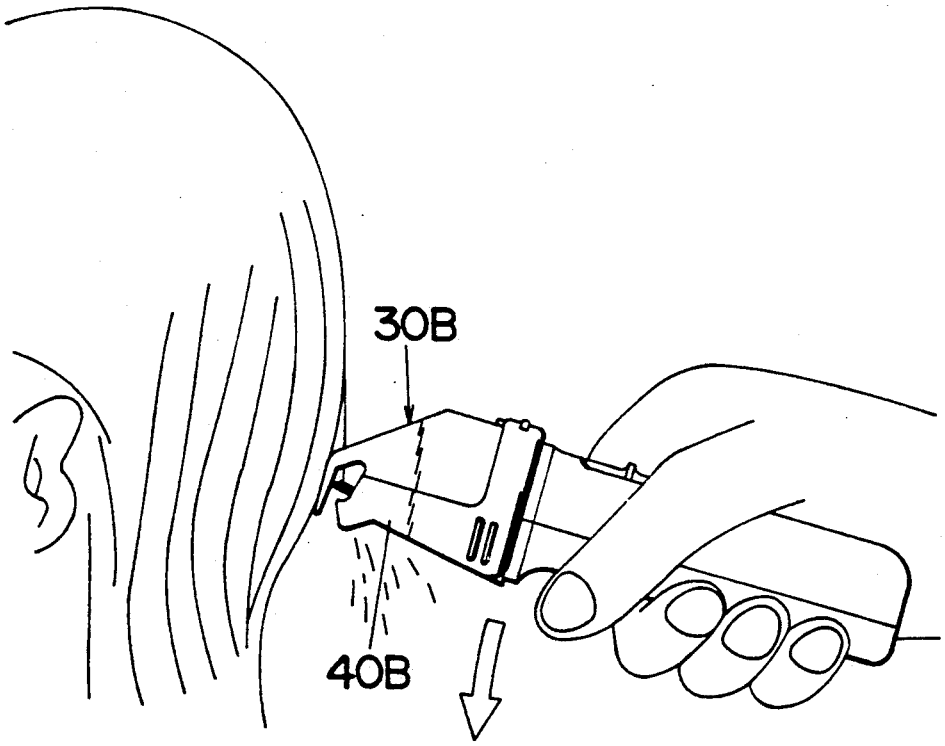
FIG. 16 a schematic view illustrating the manner in which the hair cutter is utilized for cutting the hairs.
Figure 17:
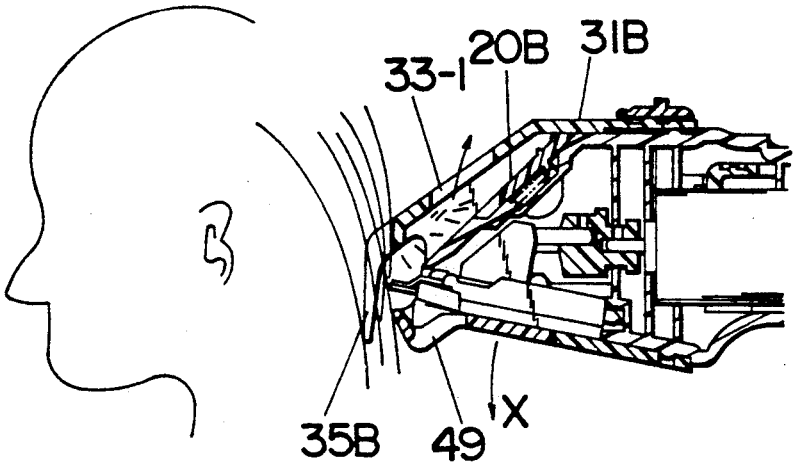
FIGS. 17 and 18 are schematic views illustrating different cutting modes for cutting the hairs.
Figure 18:
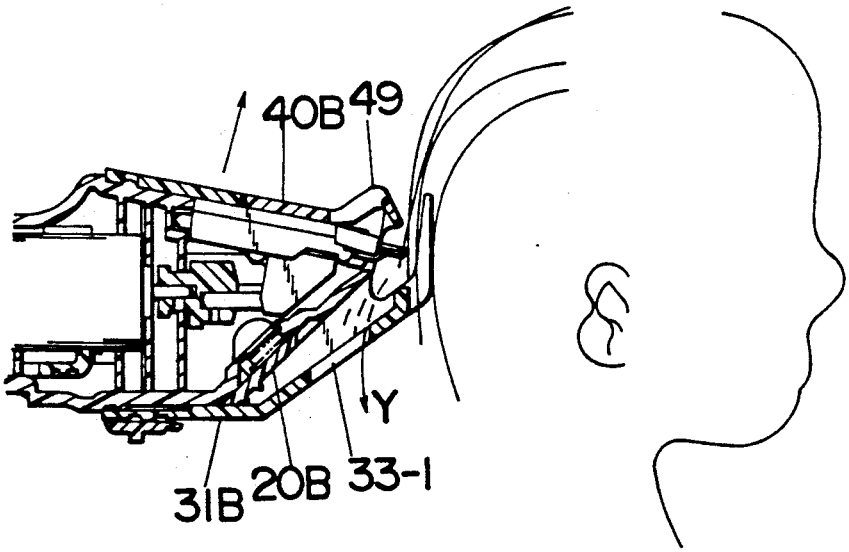

The hair cutter is manipulated generally to advance the cutter head with the comb attachment 30B along the stream of the hairs with the jaw 40B directed downwardly, as shown in FIG. 16. In this mode, the clipped hairs can be discharged outwardly through an opening 49 formed in the jaw 40B rearwardly of the hair contacting edge 46B. The main body 31B is also formed in the inclined section 33B with a like opening 33-1 for discharging the clipped hairs. Therefore, when the cutter head 20B is manipulated to advance in the direction indicated by an arrow X in FIG. 17, the clipped hairs can be discharged outwardly through the opening 49 of the jaw 40B as well as through the opening 33-1 of the main body. When the cutter head 20B is manipulated to advance along the stream of the hairs in the direction as indicated by an arrow Y of FIG. 18 with the jaw 40B directed upwardly, the clipped hairs can be discharged outwardly either through the Opening 33-1 of the main body 31B or the opening 49 of the jaw 40B.

Figure 19A:
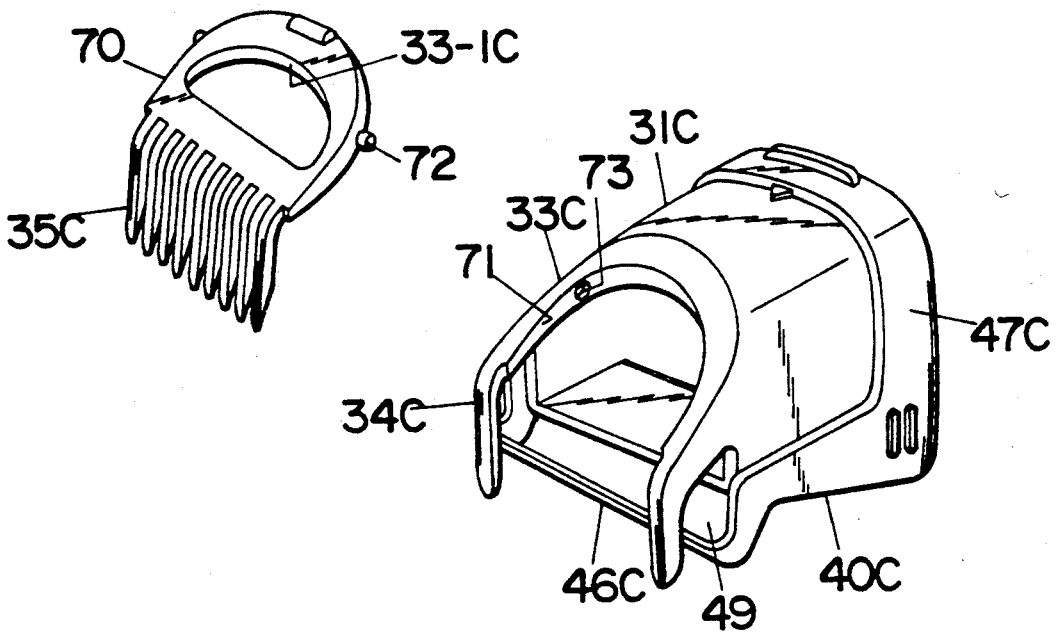
FIG. 19A is an exploded perspective view of a comb attachment in accordance with a first modification of the second embodiment.
Figure 19B:
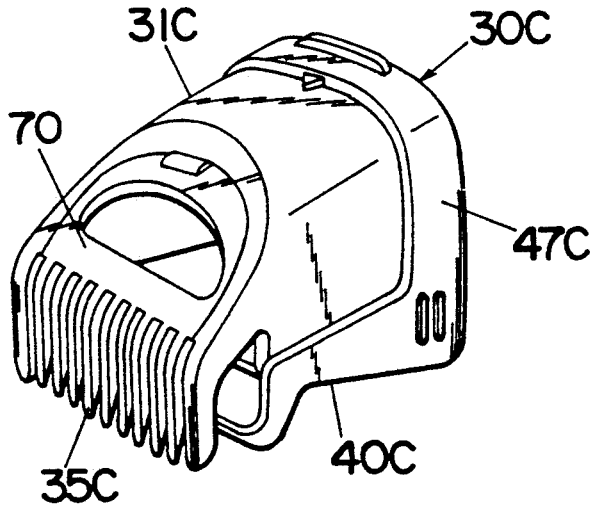
FIG. 19B is a perspective view of the comb attachment of FIG. 19A.
Figure 20:
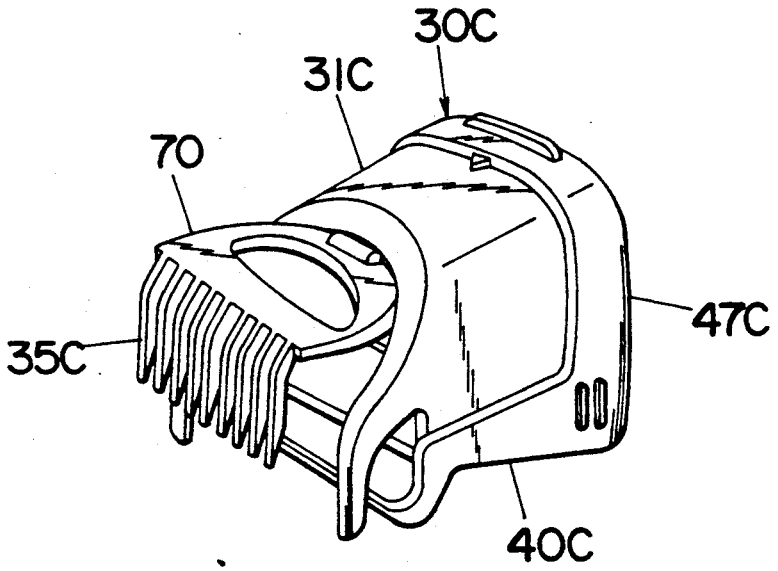
FIGS. 20 and 21 are perspective and sectional views of the comb attachment of FIG. 19A, respectively shown with a comb plate in an open position.
Figure 21:
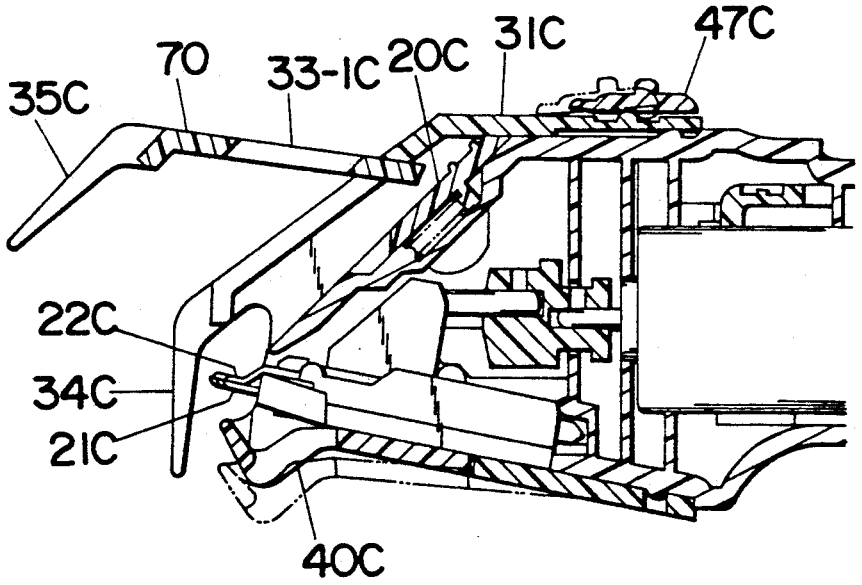

The comb attachment may be modified to have a comb plate 70 pivotable to a main body 31C, as shown in FIGS. 19A and 19B. To this end, the main body 31C is formed at a portion extending from an inclined section 33C to a nose section 34C with an opening 71 for receiving the comb plate 70. The comb pate 70 has a row of comb teeth 35C and an opening 33-1C which are of the same configuration as in the third embodiment. A pair of pivot pins 72 projecting on the upper sides of the comb plate 70 are inserted into corresponding bearing holes 73 for pivoting the comb plate 70 between a normally closed position of FIG. 19B and an open position of FIGS. 20 and 21. As shown in FIG. 21, the comb plate 70 may be opened from time to time in order to discharge through the widened opening 71 the clipped hairs accumulated in a space between the main body 31C and the inclined front end face of the cutter head 20C.

Figure 22A:
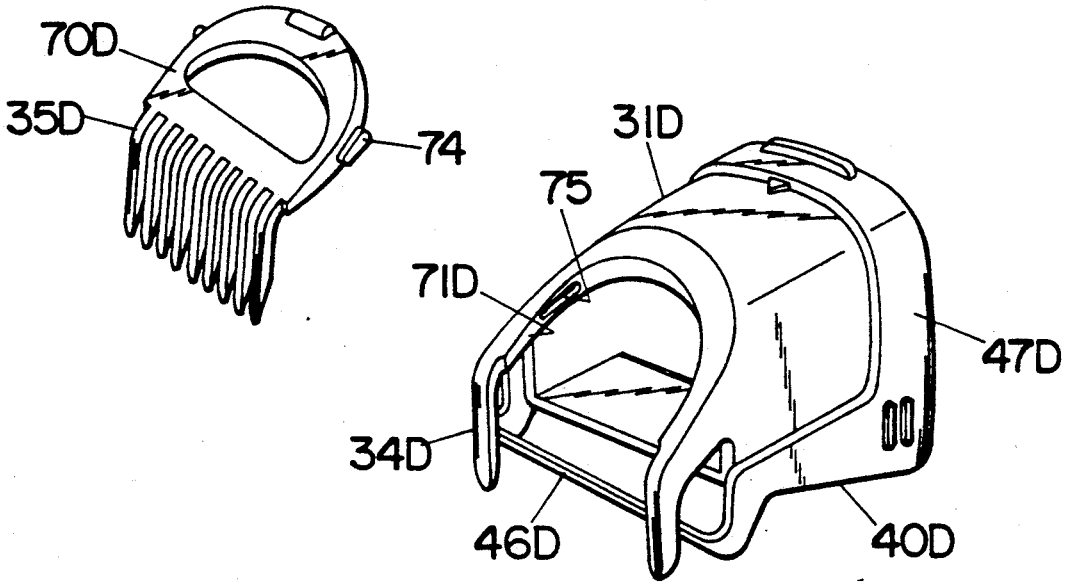
FIG. 22A is an exploded perspective view of a comb attachment in accordance with a second modification of the second embodiment.
Figure 22B:
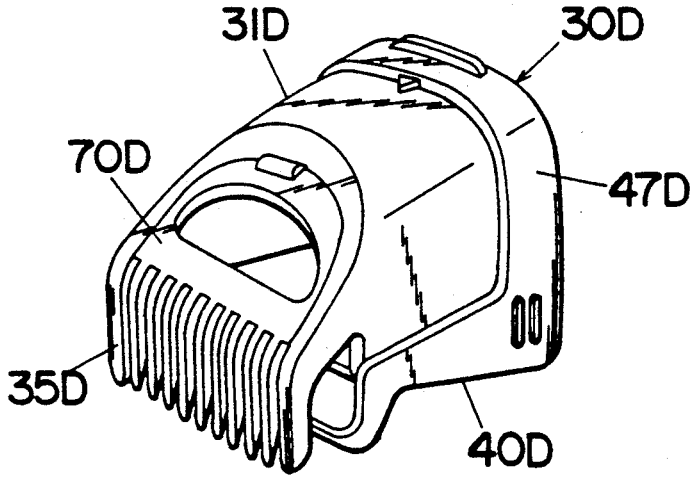
FIG. 22B is a perspective view of the comb attachment of FIG. 22A.
Figure 23:
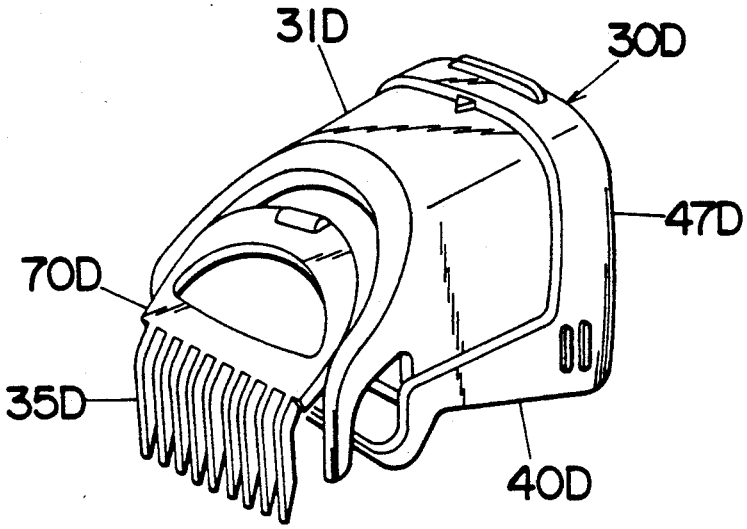
FIGS. 23 and 24 are perspective and sectional views of the comb attachment of FIG. 22A, respectively shown with a comb plate in an open position.
Figure 24:
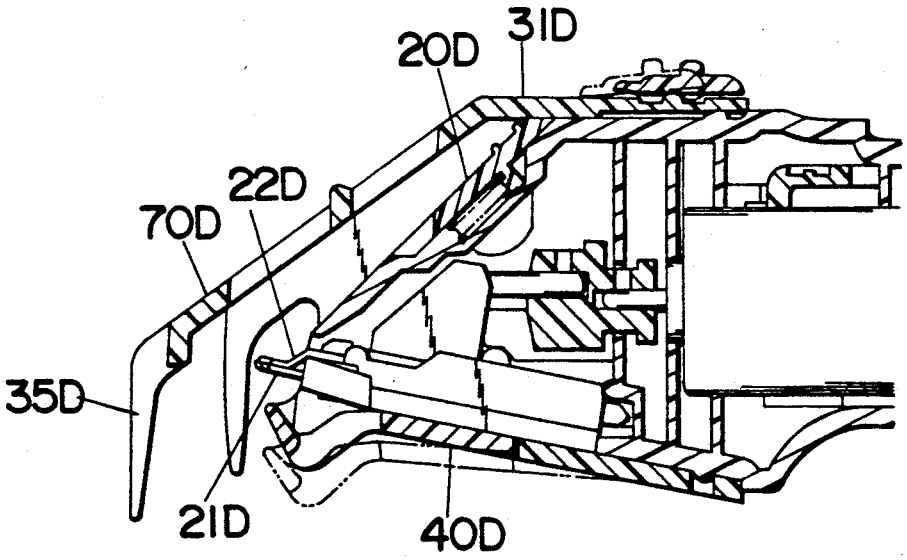

FIGS. 22 to 24 illustrate another modified structure for the comb attachment in which a like comb plate 70D is slidably received in a like opening 71D of the main body 31D for facilitating the removal of the clipped hairs out of the cutter head. The comb plate 70D has a pair of slider projections 74 on the opposite sides thereof for slidable engagement with corresponding grooves 75 in the side periphery of the opening 71D so that the comb plate 70D can be slidable between a normally closed position of FIG. 22B and an open position of FIGS. 23 and 24.

Figure 25:
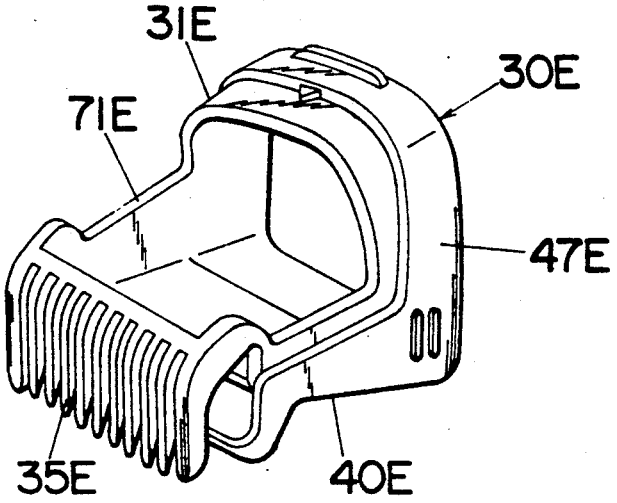
FIGS. 25 and 26 are perspective and sectional views illustrating a comb attachment in accordance with a third modification of the second embodiment.
Figure 26:
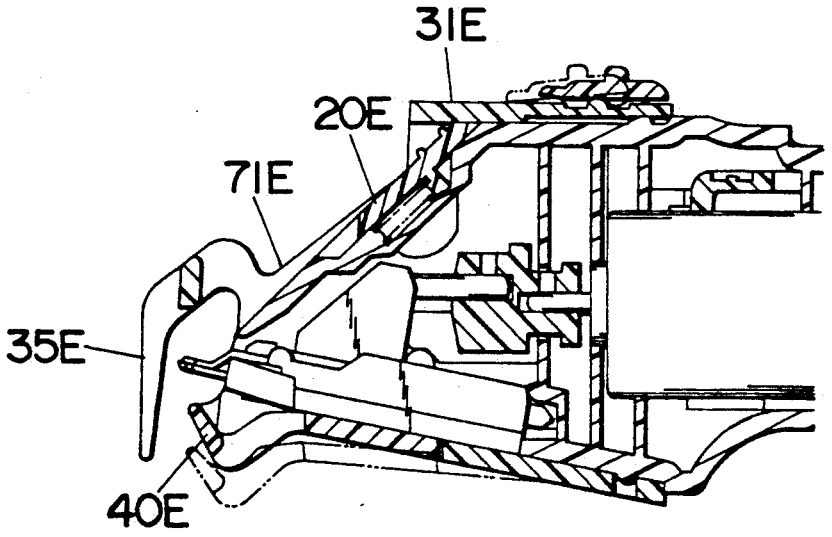

FIGS. 25 and 26 illustrate a further modified structure for the like comb attachment 30E in which a main body 31E is formed with a large opening 71E between a rear ring section 32E and a nose section 34E having a row of teeth 35E for removal of the clipped hairs therethrough.

Figure 11:
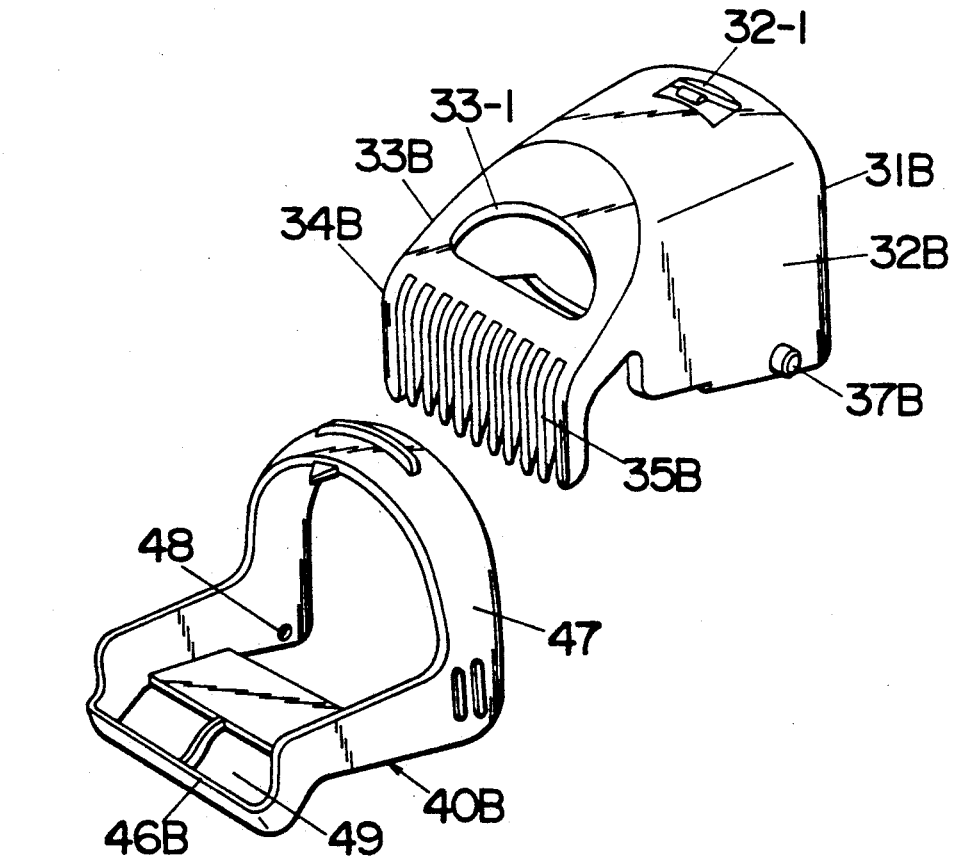
FIG. 11 is an exploded perspective view of a comb attachment fitted on a cutter head of the hair cutter of FIG. 9.
Figure 10:
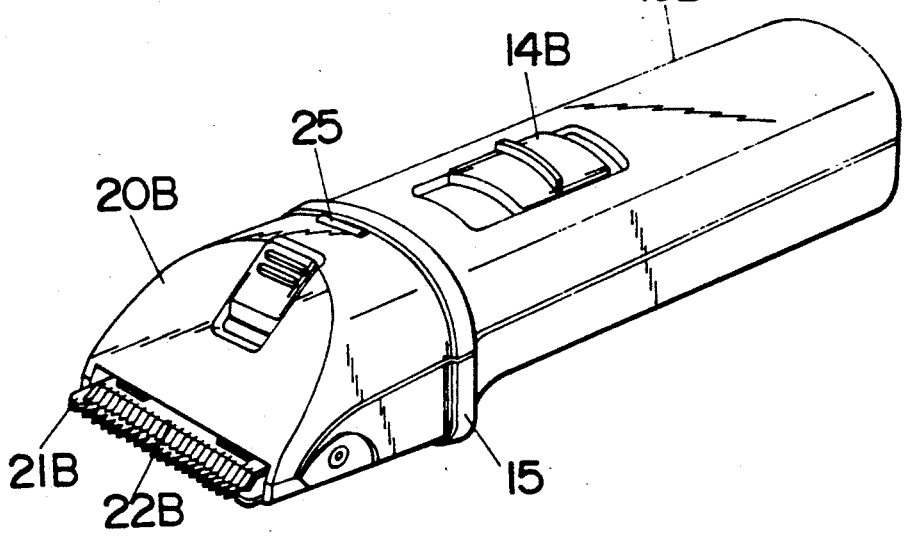
FIG. 10 is a perspective view of the hair cutter of FIG. 9 with the comb attachment removed therefrom.
Figure 27:
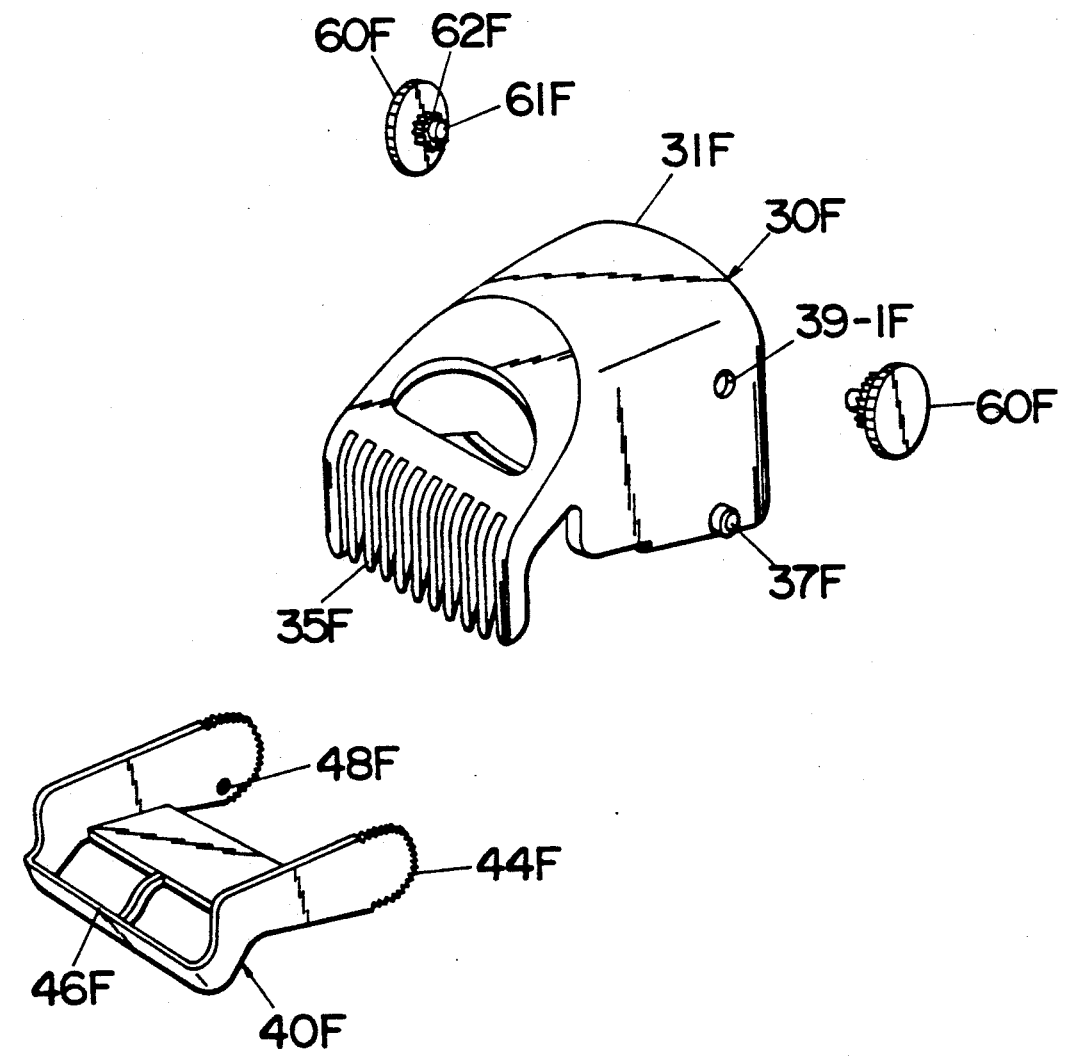
FIG. 27 is an exploded perspective view of a comb attachment in accordance with a fourth modification of the second embodiment.
Figure 28A:
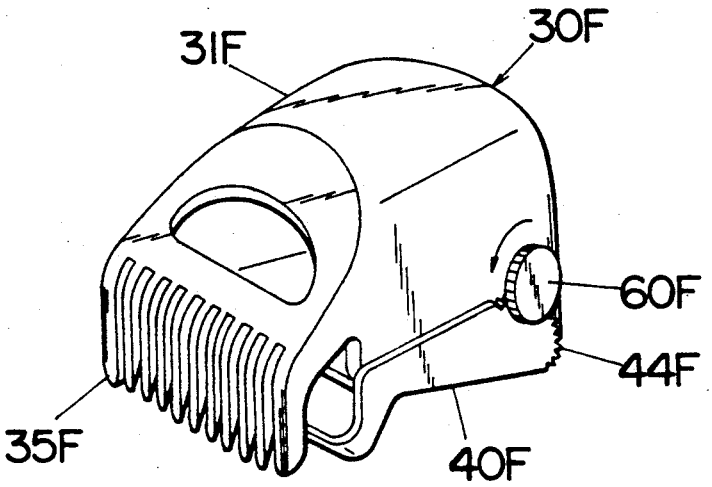
FIGS. 28A and 28B are perspective view illustrating the comb attachment of FIG. 27 with its jaw respectively shown in its closed and open positions.
Figure 28B:
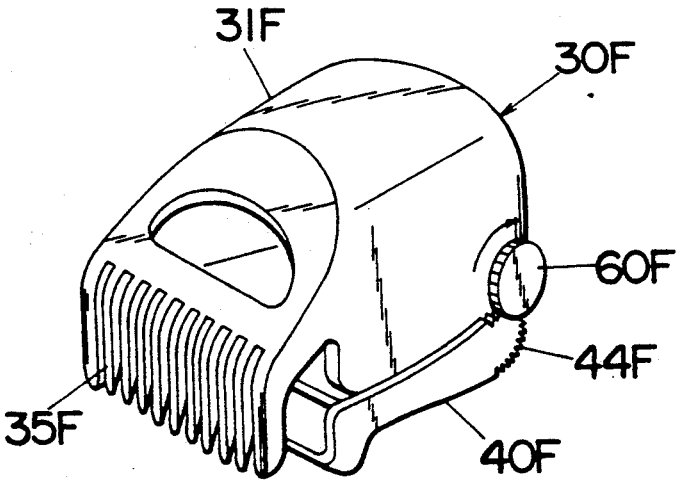
Figure 29:
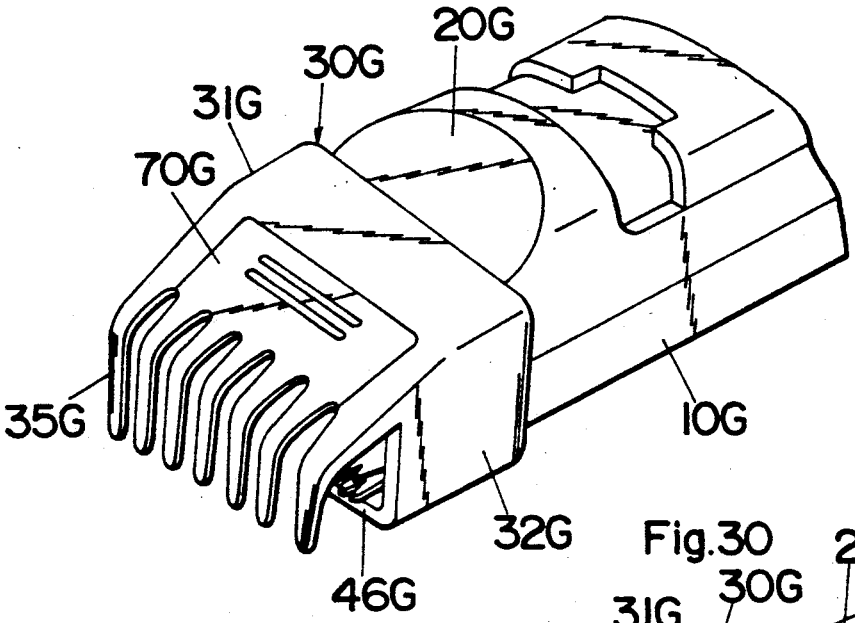
FIG. 29 is a perspective view of a head portion of a hair cutter with a comb attachment in accordance with a third embodiment of the present invention.
Figure 30:
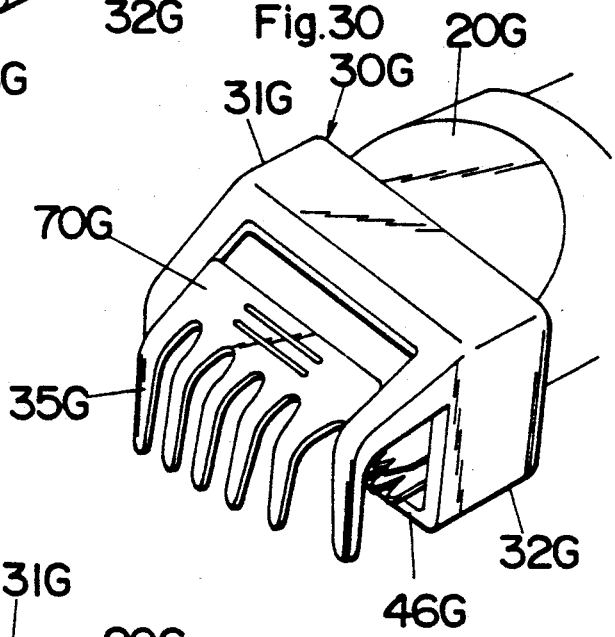
FIG. 30 is a perspective view similar to FIG. 29 but illustrating a comb plate of the comb attachment in its extended position.

FIGS. 27 to 28 illustrates a still further modified structure for a like comb attachment 30F which comprises a main body 31F of like configuration as that of FIG. 11 and a jaw 40F which is pivotally connected at its rear end to the main body 31F by engagement of pivot pins 37F of the main body 31F into bearing holes 48F in the rear ends of the jaw 40F. Dials 60F are rotatably supported on the main body 31F with individual axles 61F held in corresponding bearing holes 39-1F in the upper rear ends of the opposite side walls of the main body 31F. The side members of the jaw 40F are each formed to have a rounded edge with rack 44F which is in meshing engagement with a corresponding pinion 62F each formed around the axle 61F of the dial 60F. Thus, rotating the dial 60F causes the jaw 40F to pivot between a closed position of FIG. 28A and an open position of FIG. 28B in order to continuously adjust the distance from the cutting edge of the cutter to a hair contacting edge 46F at the leading edge of the jaw 40F for varying the cutting length of the hairs.

Third embodiment <FIGS. 29 to 32>

Figure 31:
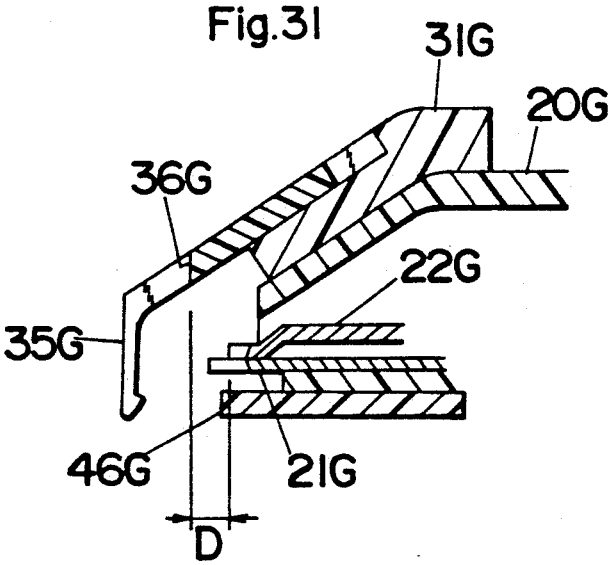
FIG. 31 is a sectional view illustrating the comb attachment in the condition of FIG. 30 relative to a cutting edge of the cutter.
Figure 32:
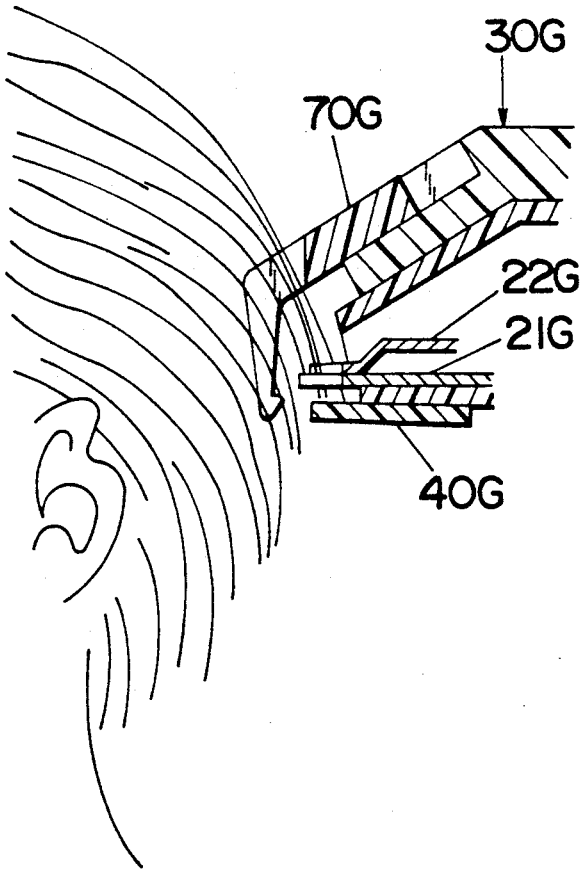
FIG. 32 is a schematic view illustrating the operation of the above hair cutter.

A hair cutter in accordance with a third embodiment of the present invention utilizes a comb attachment 30G of a different configuration fitted around a like cutter head 20G as disclosed in the previous embodiments. The comb attachment 30G comprises a tubular body 31G having a rear ring section 32G fitted around the cutter head 20G and integrally formed with a jaw 40G at the lower front end of the ring section 32G. Slidably received in an inclined section 33G extending from the ring section 32G is a comb plate 70G with a row of comb teeth 35G of which ends are bent downward past the cutting plane between stationary and movable blade 21G and 22G in a spaced relation forwardly of the cutting edge of the movable blade 22G. Thus, the comb plate 70G is slidable between a retracted position of FIG. 29 and an extended position of FIG. 30. In the like fashion as in the previous embodiment, the comb teeth 35G form therebetween comb slots of which bottom define a hair contacting edge 36G, while the jaw 40G defines a complementary hair contacting edge 46G at its front straight edge. With the sliding movement of the comb plate 70G, it is possible to vary a forward distance D from the cutting edge to the hair contacting edge 36G within the cutting plane with a fixed distance from the hair contacting edge 46G to the cutting edge, as shown in FIG. 31, thereby adjusting the thickness of the hairs to be fed to the cutting edge at the time of combing the hairs thereto by the comb teeth 35G, as shown in FIG. 32, and therefore enabling the head to cut the hairs to a desired thickness as well as to a desired length determined by the vertical distance from the cutting edge to the hair contacting edge 36G.

Fourth embodiment <FIGS. 33 to 34>

Figure 33A:
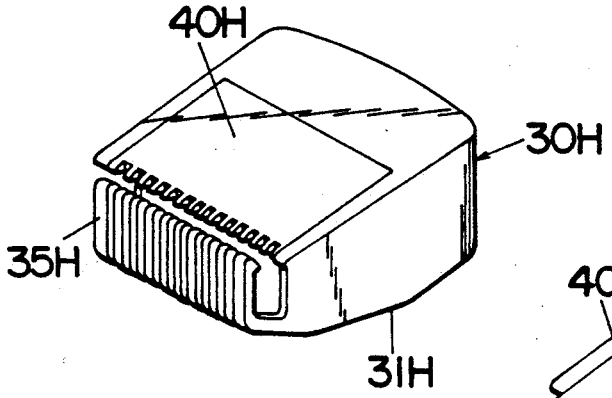
FIGS. 33A and 33B are respectively perspective views of a comb attachment for use on a hair cutter in accordance with a fourth embodiment of the present invention.
Figure 33B:
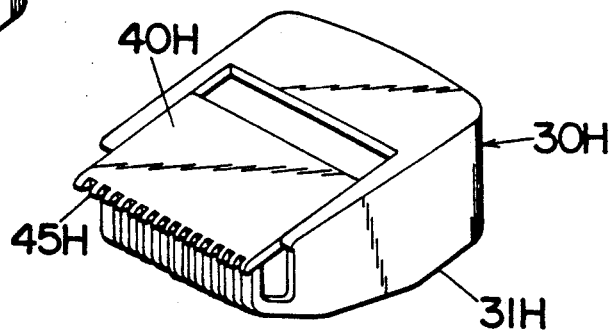
Figure 34A:
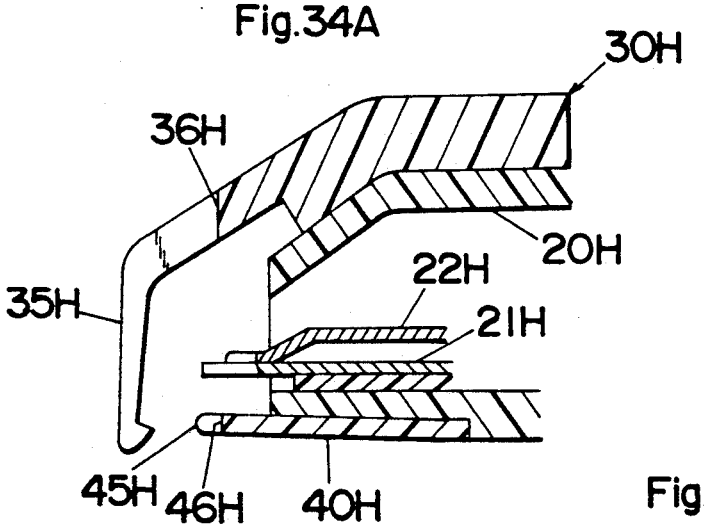
FIGS. 34A and 34B are sectional views illustrating a slider plate of the comb attachment in its retracted and extended positions, respectively.
Figure 34B:
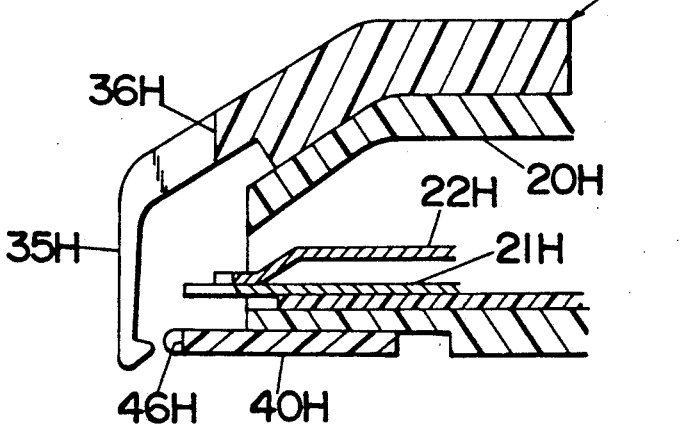

A hair cutter in accordance with a fifth embodiment of the present invention discloses an alternate scheme of adjusting the thickness of the hairs with a comb attachment 30H of different configuration. The other structures are identical to the previous embodiments and therefore like parts are designated by like numerals with a suffix letter of "H". As shown in FIGS. 33A and 33B, the comb attachment 30H comprises a main body 31H provided with a row of comb teeth 35H and a bottom plate 40H with a row of teeth 45H at its leading edge which defines a hair contacting edge 46H at the bottom of slots formed between the teeth 45H. The bottom plate 80 is slidably supported to the bottom of the main body 31H relative to the cutting edge in parallel with the cutting plane defined between stationary and movable blades 21H and 22H so as to be movable between a retracted position of FIG. 34A and an extended position of FIG. 34B. Thus, it is possible to adjust the horizontal distance from the hair contacting edge 46H to the cutting edge of the movable blade 22H in parallel with the cutting plane for varying the thickness of the hairs to be cut. It should be noted at this time that the horizontal distance and the vertical distance from the cutting edge to one of the hair contacting edges respectively in planes parallel and perpendicular to the cutting plane may be adjusted independently from one another, as illustrated in the first, third and fourth embodiments, or may be adjusted in combination with one another, as illustrated in the second embodiment.

Figure 35:
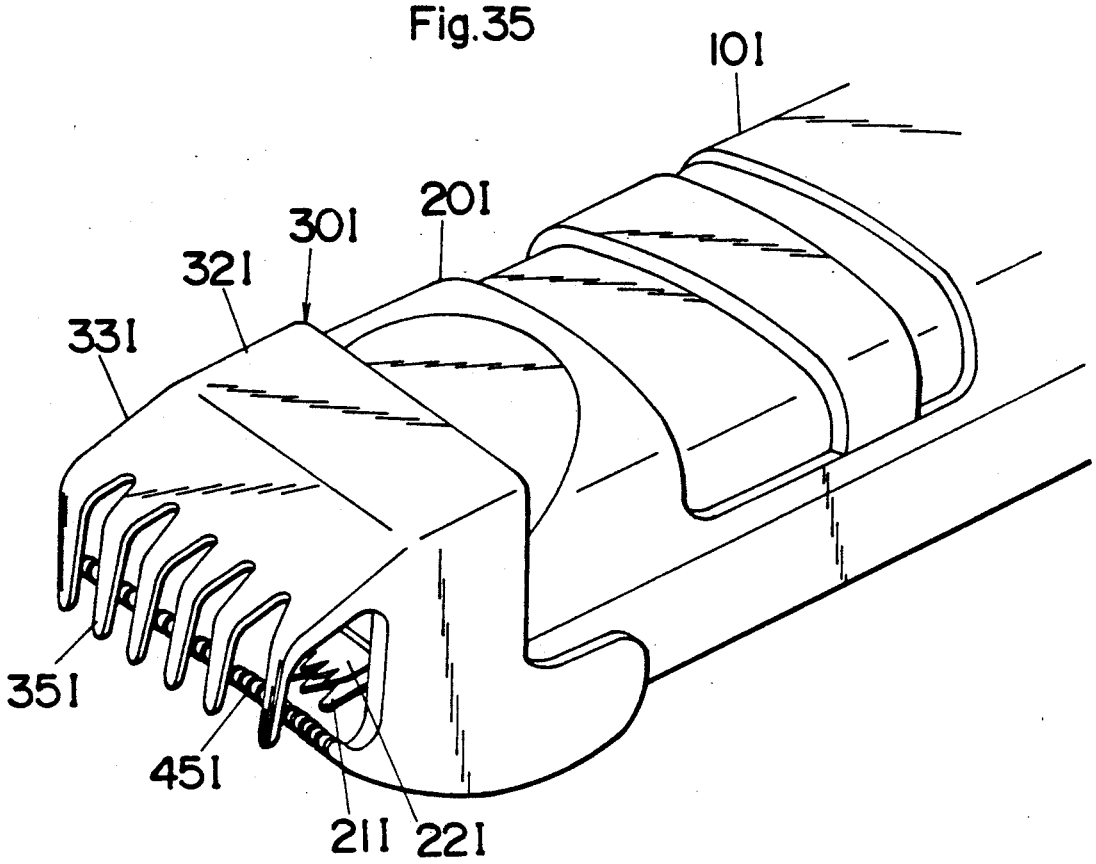
FIG. 35 is a perspective view of a head portion of a hair cutter with a comb attachment in accordance with a fifth embodiment of the present invention.
Figure 36:
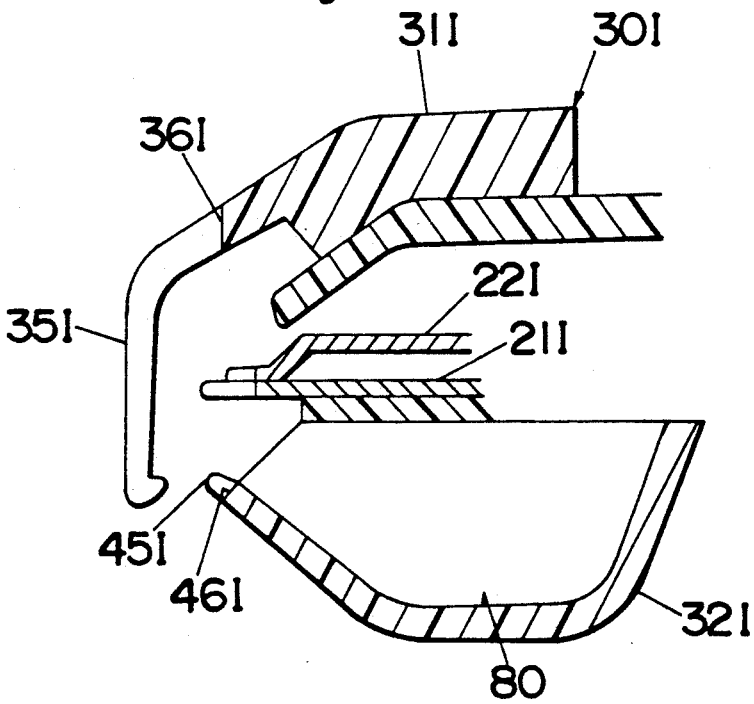
FIG. 36 is a sectional view of the comb attachment of FIG. 35.

Fifth embodiment <FIGS. 35 and 36>

A hair cutter in accordance with a fifth embodiment of the present invention disclose a comb attachment 30I of somewhat different configuration detachable to a like cutter head 20I. The comb attachment 30I comprises a main body 31I with a rear ring section 32I fitted over the cutter head 20I. The main body 30I includes a row of comb teeth 35I extending from an inclined section 33I and bent downward past the cutting plane defined between stationary and movable blades 21I and 22I in a spaced relation forwardly of the cutting edge of the movable blade 22I. The lower front end of the ring section 32I is formed to have a row of teeth 45I defining thereat a hair contacting edge 46I which is cooperative with a hair contacting edge 36I at the bottom of comb slots formed between the comb teeth 35I for supporting the hairs at portions spaced along the length of the hairs prior to shearing the hairs, in the like manner as in the previous embodiment. The bottom of the ring section 32I is bulged outwardly to form inside thereof a recess so for collecting the clipped hairs and preventing the clipped hairs from scattering around the cutter head.

what is claimed is:

1. A hair cutter comprising:

a cutter head with a cutter which comprises a toothed stationary blade and a toothed movable blade defining a cutting plane between toothed edges thereof, said movable blade being driven to reciprocate relative to said stationary blade in hair shearing engagement between said toothed edges with said movable blade defining a cutting edge at its leading toothed edge; and a pair of first and second hair pressing members disposed at the front end of said cutter head each pressing member having a respective hair contacting edge, said first hair pressing member having a number of comb slots arranged in parallel with said toothed edge of said movable blade, with said hair contacting edge of said first pressign member being defined by the bottom ends of said comb slots; said second hair pressing member having a plurality of comb slots arranged in parallel with said toothed edge and the hair contacting edge of said second hair pressing member being defined by the bottom ends of said slots; said first and second hair pressign members being located on the opposite sides of said cutting plane respectively to have said individual hair contacting edges spaced across said cutting plane in such a manner that said cutting edge is positioned on or rearwardly of a straight line connecting said hair contacting edges of said first and second hair pressing members.

2. A hair cutter as set forth in claim 1, wherein said first hair pressing member is formed with comb teeth alternating said comb slots and extending forwardly of said cutting edge and bent toward said second hair pressing member beyond said cutting edge.

3. A hair cutter as set forth in claim 1, wherein said first hair pressing member is disposed on the same side of said movable blade from said cutting plane.

4. A hair cutter as set forth in claim 1, wherein at least one of said first and second hair pressing members is movable relative to said cutter so as to vary a distance from the hair contacting edge thereof to said cutting edge in a direction parallel to said cutting plane.

5. A hair cutter as set forth in claim 1, wherein at least one of said first and second hair pressing members is movable relative to said cutter so as to vary a distance from the hair contacting edge thereof to said cutting edge in a direction perpendicular to said cutting plane.

6. A hair cutter as set forth in claim 1, wherein said second hair pressing member is formed with a recess rearwardly of said hair contacting edge for collection of clipped hairs.

7. A hair cutter comprising:

a cutter head with a cutter which comprises a toothed stationary blade and a toothed movable blade defining a cutting plane between toothed edges thereof, said movable blade being driven to reciprocate relative to said stationary blade in hair shearing engagement between said toothed edges with said movable blade defining a cutting edge at its leading toothed edge;

a pair of first and second hair pressing members disposed at the front end of said cutter head and having respective hair contacting edges, said first hair pressing member having a number of comb slots arranged in parallel with said toothed edges of said movable blade with said comb slots defining at their bottom ends said hair contacting edge of said first hair pressign member, said first and second hair pressing members being located on the opposite sides of said cutting plane respectively to have said individual hair contacting edges spaced across said cutting plane in such a manner that said cutting edge is positioned on or rearwardly of a line connecting said hair contacting edges of said first and second hair pressing members and wherein said first hair pressing member extends forwardly of said cutting edge and is bent toward said second hair pressing member beyond said cutting edge.

8. A hair cutter comprising:

a cutter head with a cutter which comprises a toothed stationary blade and a toothed movable blade defining a cutting plane between toothed edges thereof, said movable blade being driven to reciprocate relative to said stationary blade in hair shearing engagement between said toothed edges with said movable blade defining a cutting edge at its leading toothed edge;

a pair of first and second hair pressing members disposed at the front end of said cutting head and having respective hair contacting edges, said first hair pressign member having a number of comb slots arranged in parallel with said toothed edges of said movable blade with said comb slots defining at their bottom ends said hair contacting edge of said first hair pressing member, said first and second hair pressing members located on opposite sides of said cutting plane respectively to have said individual hair contacting edges spaced across said cutting plane in such a manner that said cutting edge is positioned on or rearwardly of a line connecting said hair contacting edges of said first and second hair pressing members and wherein at least one of said first and second hair pressing members is movable relative to said cutter so as to vary a distance from the hair contacting edge thereof to said cutting edge in a direction perpendicular to said cutting plane.

9. A hair cutter comprising:

a cutter head with a cutter which comprises a toothed stationary blade and a toothed movable blade defining a cutting plane between toothed edges thereof, said movable blade being driven to reciprocate relative to said stationary blade in hair shearing engagement between said toothed edges with said movable blade defining a cutting edge at its leading toothed edge;

a pair of first and second hair pressign members disposed at the front end of said cutter head and having respective hair contacting edges, said first hair pressing member having an umber of comb slots arranged in parallel with said toothed edges of said movable blade with said comb slots defining at their bottom ends said hair contacting edges of said first hair pressign member, said first and second hair pressing members located on opposite sides of said cutting plane respectively to have said individual hair contacting edges spaced across said cutting plane in such a manner that said cutting edge is positioned on or rearwardly of a line connecting said hair contacting edges of said first and second hair pressing members and wherein said second hair pressing member is formed with a recess rearwardly of said hair contacting edge for collection of clipped hairs.

* * * * *